US005976707A

United States Patent [19]

Grab

[11] Patent Number: 5,976,707

[45] **Date of Patent: *Nov. 2, 1999**

[54] CUTTING INSERT AND METHOD OF MAKING THE SAME

[75] Inventor: George P. Grab, Greensburg, Pa.

[73] Assignee: Kennametal Inc., Latrobe, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/721,414

[22] Filed: Sep. 26, 1996

[51] Int. Cl.[6] ..... C22C 29/00; B22F 7/00

[52] U.S. Cl. ..... 428/547; 428/548; 428/698; 428/699; 75/238; 75/242; 419/26; 407/119; 51/307

[58] Field of Search ..... 75/238, 242; 419/26; 51/307; 428/545, 547, 548, 698, 699; 407/118, 119

[56] References Cited

U.S. PATENT DOCUMENTS

| | | | |
|---|---|---|---|
| Re. 34,180 | 2/1993 | Nemeth et al. | 428/547 |
| 3,994,692 | 11/1976 | Rudy | 29/182.5 |
| 3,999,953 | 12/1976 | Kolaska et al. | 29/182.7 |
| 4,018,631 | 4/1977 | Hale | 148/31.5 |
| 4,447,263 | 5/1984 | Sugizawa et al. | 75/233 |
| 4,610,931 | 9/1986 | Nemeth et al. | 428/547 |
| 4,643,620 | 2/1987 | Fujii et al. | 407/119 |
| 4,755,399 | 7/1988 | Fujii et al. | 427/277 |
| 4,820,482 | 4/1989 | Fischer et al. | 419/15 |
| 4,942,097 | 7/1990 | Santhanam et al. | 428/552 |
| 4,990,410 | 2/1991 | Saitoh et al. | 428/547 |
| 5,250,367 | 10/1993 | Santhanam et al. | 428/698 |
| 5,279,901 | 1/1994 | Akerman et al. | 428/469 |
| 5,296,016 | 3/1994 | Yoshimura et al. | 75/238 |
| 5,306,326 | 4/1994 | Oskarsson et al. | 75/238 |
| 5,336,292 | 8/1994 | Weinl et al. | 75/230 |
| 5,451,469 | 9/1995 | Gustafson et al. | 428/548 |
| 5,453,241 | 9/1995 | Akerman et al. | 419/14 |
| 5,484,468 | 1/1996 | Östlund et al. | 75/236 |

FOREIGN PATENT DOCUMENTS

| | | |
|---|---|---|
| 0515340 | 11/1992 | European Pat. Off. . |
| 3-32502 | 2/1991 | Japan . |
| 8-174310 | 7/1996 | Japan . |
| 1115908 | 6/1968 | United Kingdom . |
| 1393115 | 5/1975 | United Kingdom . |
| 1393116 | 5/1975 | United Kingdom . |
| WO90/08613 | 8/1990 | WIPO . |

OTHER PUBLICATIONS

Kennametal Inc. Lab Report No. R3030, dated Sep. 9, 1977 (Analysis of a Carbology Grade 570).

Nemeth, B. J., et al., "The Microstructure Features and Cutting Performance of the High Edge Strength Kennametal Grade KC850," Proc. Tenth Plansee Seminar, Metalwerk Plansee, A.G., Reutte, Tyrol, Austria (1981), pp. 613–627.

Santhanam, A. T., et al., "Innovations in Coated Carbide Cutting Tools," ASM Proceedings of a Conference on Advances in Tool Materials, Scottsdale, AZ (1987) (Paper 8701–001), pp. 67–76).

Tsuda et al., Development of Functionally Graded Sintered Hard Materials, Proceedings of 1996 European Conference on Advanced in Hard Materials Production, pp. 45–52.

International Search Report for PCT/US97/12691.

*Primary Examiner*—Ngoclan Mai

*Attorney, Agent, or Firm*—John J. Prizzi

[57] ABSTRACT

A cutting insert that has a flank face and a rake face and a cutting edge at the juncture thereof. The substrate presents a bulk region that contains a metallic binder, as well as one or more of Group IVB, Group VB, and Group VIB metal carbides and/or carbonitrides. The substrate further includes a flank surface region near the flank face of the substrate that has a solid solution metal carbide and/or carbonitride content greater than that of the bulk region. The substrate includes a rake surface region near the rake face of the substrate with a solid solution metal carbide content that is less than that of the flank surface region.

20 Claims, 1 Drawing Sheet

CUTTING INSERT AND METHOD OF MAKING THE SAME

BACKGROUND

The invention pertains to a coated cutting insert wherein the flank face has improved wear resistance and the rake face has improved impact resistance.

The article entitled "The Microstructure Features and Cutting Performance of the High Edge Strength Kennametal Grade KC850" by Nemeth et al., (*Proc. Tenth Plansee Seminar*, Metalwerke Plansee A. G., Reutte, Tyrol, Austria, (1981), pp. 613–627, mentions that, " . . . by combining a high impact resistant rake face with a deformation resistant flank face of a coated insert, we can substantially increase edge strength without significantly altering wear resistance." This article describes the use of a cutting insert which has a substrate with binder enrichment on the rake surface and the bulk microstructure (or composition) on the flank surface.

U.S. Pat. No. 4,610,931, to Nemeth et al., (U.S. Pat. No. Reissue 34,180) describes a coated cutting insert wherein the substrate has binder enrichment on the rake face and the bulk substrate composition on the flank face of the substrate. None of the above-mentioned documents presents a coated cutting insert with a substrate wherein the substrate has a flank face with improved wear resistance due to a flank surface region with a higher hard phase (e.g., solid solution carbide and/or carbonitride) content and a rake surface region with a microstructure (or composition) different from that of the flank surface region and which provides improved impact resistance.

SUMMARY

In one form thereof, the invention is a cutting insert that comprises a flank face and a rake face with a cutting edge at a junction thereof. The cutting insert has a substrate which comprises a bulk region that includes a metallic binder, and one or more of a first metal carbide, a first metal carbonitride, a second metal carbide, and a second metal carbonitride, either alone or in solid solution or in mixtures. The first metal and the second metal, which is different from the first metal, are each selected from the group consisting of the Group IVB (titanium, zirconium, and hafnium), Group VB (vanadium, niobium, and tantalum), and Group VIB (chromium, molybdenum, and tungsten) transition metals.

The substrate includes a flank surface region near the flank face of the substrate, and a rake surface region near the rake face of the substrate. The flank surface region includes a hard constituent comprising one or more of a solid solution of metal carbides and carbonitrides of the first metal and the second metal. The content of the hard constituent in the flank surface region is greater than the content of the hard constituent in the bulk region. The content of the hard constituent in the rake surface region is less than the content of the hard constituent in the flank surface region.

BRIEF DESCRIPTION OF THE DRAWINGS

The following is a brief description of the drawings which form a part of this patent application.

DETAILED DESCRIPTION

Figure 1:
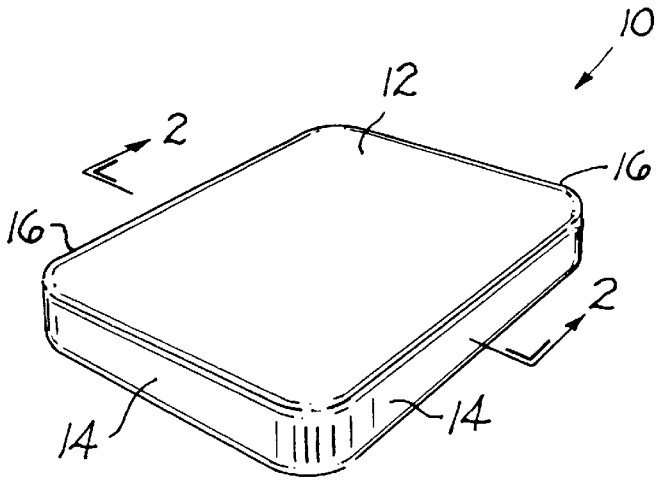
FIG. 1 is an isometric view of a specific embodiment of a cutting insert of the invention.
Figure 2:
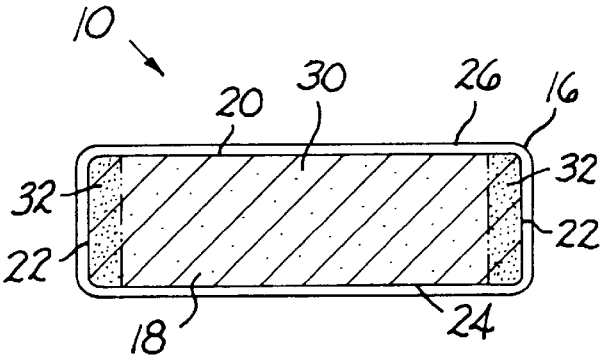
FIG. 2 is a cross-sectional view of the cutting insert of FIG. 1 taken along section line 2—2.

Referring to the drawings, FIGS. 1 and 2 illustrate a first specific embodiment of a cutting insert of the invention, generally designated as 10. Cutting insert 10 is an indexable cutting insert which has a rake face 12, a flank face 14, and a cutting edge 16 which is at the juncture of the rake face 12 and the flank face 14. Cutting insert 10 further has a substrate 18 which preferably presents two rake faces 20 and 24, and a flank face 22 (which extends around the periphery of the cutting insert 10). Cutting insert 10 also has a coating 26 on the rake faces 20 and 24, and the flank face 22 of the substrate 18.

Referring to the substrate 18 of cutting insert 10, the substrate 18 has a bulk region 30 which is in the interior of the substrate 18. In the case of cutting insert 10, the bulk region 30 extends between the rake faces 20 and 24 of the substrate 18. The composition of the bulk region 30 is that of the basic bulk composition of the substrate 18.

The substrate further has a flank surface region 32 which extends inwardly from the flank surface 22 toward the interior of the substrate 18. As will become apparent from the discussion set forth below, the flank surface region 32 has a microstructure (and composition) that is different from that of the bulk region 30. Very briefly, the flank surface region 32 has a solid solution carbide content that is higher than the solid solution carbide content of the bulk region 30. FIG. 2 depicts the thickness of the flank surface region 32 in an exaggerated fashion for illustrative purposes. The typical thickness of this region is between about 10 micrometers ($\mu$m) and 20 $\mu$m.

In a preferred embodiment for a cemented carbide, the bulk composition of the substrate is a tungsten carbide based cemented carbide containing at least 70 weight percent tungsten carbide, and more preferably, at least 80 weight percent tungsten carbide. The binder is preferably cobalt or a cobalt alloy and, preferably, has a bulk concentration of between about 2 and about 12 weight percent. The more preferable bulk cobalt content is between about 5 and about 8 weight percent. Even more preferably, the bulk cobalt content is between about 5.5 and about 7 weight percent.

The bulk composition of the substrate also preferably contains (although it is not a necessity) solid solution carbide forming elements such as titanium, hafnium, zirconium, niobium, tantalum, chromium, and vanadium with these elements being preferably selected from titanium, niobium and tantalum, either alone or in combination with each other. These elements preferably may be added to the initial powder mixture as an element, alloy, carbide, nitride or carbonitride.

When these elements are present, it is preferable that the concentration of these elements (when present) is within the following ranges: the sum of the tantalum and niobium content is up to about 12 weight percent, and the titanium content is up to 6 weight percent. The more preferable concentration of these elements (when present) is that the sum of the tantalum content and the niobium content is between about 3 and about 7 weight percent and the titanium content is between about 0.5 and about 6 weight percent. The most preferable concentration of these elements (when present) is that the sum of the tantalum content and the niobium content is between about 4 and about 6.5 weight percent, and the titanium content is between about 1.5 and about 4.0 weight percent. For each one of the above-mentioned ranges for the sum of the tantalum and niobium contents, the maximum amount of the niobium content is preferably equal to about thirty percent of the sum of the tantalum and niobium contents.

In regard to the solid solution carbide forming elements in the bulk region of the substrate, it should be appreciated that these elements form, at least to some extent (and preferably for the most part), solid solution carbides and/or solid solution carbonitrides with the tungsten carbide in the substrate. However, these elements may be present as simple carbides, carbonitrides and nitrides and/or in combination with solid solution carbides.

Specific compositions of the bulk region for cemented carbide cutting inserts may include, but are not limited to, the compositions set forth below. These compositions produce a sintered substrate which has surface binder enrichment.

Composition No. 1 comprises about 5.8 weight percent cobalt, about 5.2 weight percent tantalum, no greater than about 0.4 weight percent niobium, about 2.0 weight percent titanium, and the balance tungsten and carbon. For Composition No. 1, the average grain size of the tungsten carbide is between about 1 and about 8 micrometers ($\mu$m), the specific gravity is between about 13.95 and about 14.25 grams per cubic centimeter (g/cm$^3$), the Rockwell A hardness is between about 91.3 and about 91.9, the magnetic saturation is 100 percent, and the coercive force is between about 135 and about 185 oersteds. The description of the binder enrichment for Composition No. 1 is set forth in the above-mentioned Nemeth et al. article ("The Microstructure Features and Cutting Performance of the High Edge Strength Kennametal Grade KC850," by Nemeth et al. (*Proc. Tenth Plansee Seminar*, Metalwerke Plansee A. G., Reutte, Tyrol, Austria, (1981), pp. 613–627).

Composition No. 2 comprises about 6.0 weight percent cobalt, about 4.6 weight percent tantalum, about 1.0 weight percent niobium, about 3.5 weight percent titanium, and the balance tungsten and carbon. For Composition No. 2, the average grain size of the tungsten carbide is between about 1 and about 6 $\mu$m, the specific gravity is between about 13.30 and about 13.60 g/cm$^3$, the Rockwell A hardness is between about 91.8 and about 92.4, the magnetic saturation is between about 88 percent and about 100 percent, and the coercive force is between about 155 and about 205 oersteds.

Composition No. 3 comprises about 6.3 weight percent cobalt, about 3.5 weight percent tantalum, about 1.5 weight percent niobium, about 2.0 weight percent titanium, and the balance tungsten and carbon. For Composition No. 3, the average grain size of the tungsten carbide is between about 1 and about 7 $\mu$m, the specific gravity is between about 13.80 and about 14.10 g/cm$^3$, the Rockwell A hardness is between about 90.7 and about 91.3, the magnetic saturation is between about 88 and 100 percent, and the coercive force is between about 125 and about 155 oersteds.

The description of the binder enrichment for Compositions Nos. 2 and 3 is set forth in U.S. Pat. No. Reissue 34,180 (U.S. Pat. No. 4,610,931) to Nemeth et al.

The flank surface region 32 presents a microstructure which has a higher content of solid solution carbides than does the bulk region 30. For example, the bulk region may comprise tungsten carbide, cobalt, and a solid solution carbide of tungsten, titanium, niobium and tantalum while the flank surface region may comprise tungsten carbide and cobalt along with a higher concentration of a solid solution carbide or carbonitride of tungsten and titanium.

A preferable range of solid solution carbide enrichment for the flank surface region is between about 200 percent and about 400 percent of the solid solution carbide content of the bulk substrate. A more preferable range of solid solution carbide enrichment is between about 300 percent and about 400 percent of the bulk solid solution carbide content. The most preferable range of solid solution carbide enrichment is between about 350 percent and about 400 percent of the bulk solid solution carbide content.

A sintered substrate of Composition No. 3 had the following two coating schemes deposited as the layer 88 on the as-ground flank surface. Coating Scheme No. 1 comprised a 3 micrometer ($\mu$m) thick PVD TiN/TiCN/TiN coating. Coating Scheme No. 2 comprised a CVD coating consisting of a 1 $\mu$m thick inner layer of TiCN and a 7 $\mu$m thick outer layer of TiN.

In the case of a cermet cutting insert, the substrate is a titanium carbonitride-based composition. The bulk composition of the cermet comprises between about 1 to about 14 weight percent cobalt, between about 3 to about 11 weight percent nickel, between about 5 to about 11 weight percent molybdenum, between about 13 to about 23 weight percent tungsten, up to about 10 weight percent tantalum, and the balance being titanium, carbon, and nitrogen. Specific compositions for the bulk region of the cermet substrate may include, but are not limited to, the following compositions:

Composition No. 4 comprises about 5.1 weight percent cobalt, about 4.2 weight percent nickel, about 10.2 weight percent molybdenum, about 21 weight percent tungsten, and the balance titanium, nitrogen, and carbon.

Composition No. 5 comprises about 1.8 weight percent cobalt, about 8.5 weight percent tantalum, about 9.8 weight percent nickel, about 10 weight percent molybdenum, about 15 weight percent tungsten, and the balance titanium, nitrogen, and carbon.

Composition No. 6 comprises about 12 weight percent cobalt, about 8 weight percent tantalum, about 6.5 weight percent molybdenum, about 4.3 weight percent nitrogen, about 17.5 weight percent tungsten, about 6 weight percent nickel, and the balance titanium and carbon.

The coating 26 may vary in thickness, but a preferable range is between 3 micrometers ($\mu$m) and 12 $\mu$m. The coating may be applied by any one of a variety of suitable techniques; however, the typical (and most preferable) techniques comprise chemical vapor deposition (CVD) and physical vapor deposition (PVD). The coating material may be any hard material such as, for example, cubic boron nitride (cBN), diamond, diamond like coating, titanium carbide, titanium nitride, titanium carbonitride, alumina, and titanium aluminum nitride.

Figure 3:
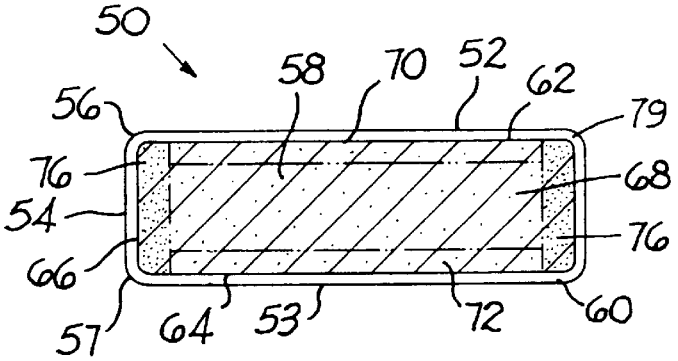
FIG. 3 is a cross-sectional view of a second specific embodiment of the cutting insert of the invention.

Referring to FIG. 3, there is illustrated a cross-sectional view of a second specific embodiment of a cutting insert of the invention, generally designated as 50. Cutting insert 50 includes two rake face 52 and 53, and a flank face 54. The rake faces 52, 53 and the flank face 54 intersect to form a cutting edges 56, 57. The cutting edges may be in a sharp, honed (e.g., 0.0005 to 0.003 inch radius hone), chamfered, or chamfered and honed condition. The cutting insert 50 further includes a substrate 58 and a coating 60.

The substrate 58 presents two rake faces 62 and 64 and a flank face 66 which extends about the periphery of the substrate 58. The substrate 58 includes a bulk region 68 which presents a composition and microstructure that is of the basic bulk composition. These bulk compositions of cemented carbides and cermets are similar to those for the first specific embodiment of the cutting insert 10.

The substrate 58 further includes a first rake surface region 70 which begins at (or near) and extends inwardly from the rake face 62 of the substrate 58. The substrate 58 also includes a second rake surface region 72 which begins at (or near) and extends inwardly from the bottom rake face 64 of the substrate 58. The first rake surface region 70 and the second rake surface region 72 present a microstructure and composition that is enriched in the binder so that the binder content is higher in these regions (70, 72) than in the bulk region 68.

In regard to the extent of binder enrichment in the first and second rake surface regions, a preferable range of binder enrichment is between about 125 and about 300 percent of the bulk binder content. A more preferable range is between 150 and about 300 percent of the bulk binder content. The most preferable range is between about 150 and about 250 percent of the bulk binder content. FIG. 3 depicts the thicknesses of the first rake surface region 70 and the second rake surface region 72 in an exaggerated fashion for illustrative purposes. The typical thickness of these regions is described in the Nemeth et al. article and U.S. Pat. No. Reissue 34,180 (U.S. Pat. No. 4,610,931), to Nemeth et al.

The substrate 58 further has a flank surface region 76 which begins at (or near) and extends inwardly from the flank face 66 of the substrate 58. The microstructure (and composition) of the flank surface region 76 is different from that of the bulk region 68 in that the flank surface region 76 has a solid solution carbide content that is higher than the solid solution carbide content of the bulk region 68.

The preferable ranges for the extent of the solid solution carbide enrichment are the same as those set forth above on the description of the flank surface region 32 of cutting insert 10. These ranges will not be repeated herein, but are applicable to cutting insert 50. FIG. 3 depicts the thickness of the flank surface region 76 in an exaggerated fashion for illustrative purposes. The typical thickness of this region is between about 10 $\mu$m and 20 $\mu$m.

The cutting insert further includes a final coating 79 which is deposited on the surface of the substrate. The coating 79 is adjacent to the first surface rake region 70, the second surface rake region 72, and the flank surface region 76. The coating 79 may comprise one or more layers of various compounds. The coating 79 may also be deposited by chemical vapor deposition (CVD), physical vapor deposition (PVD) or both CVD and PVD.

The processes for producing the cutting inserts (10, 50) are set forth below.

The first step in the basic process is to blend the powder components so as to provide a powder blend. It is typical that the blending will occur in a ball mill containing solvent, fugitive binder (or lubricant) and the powder charge ingredients. One example of the blending step is described in U.S. Pat. No. 5,250,367, to Santhanam et al., for a Binder Enriched CVD and PVD Coated Cutting Insert, which is hereby incorporated by reference herein.

Once the powder components have been sufficiently blended and the charge dried, the powder blend will be pressed into the basic shape of the cutting insert so as to form a green compact. This green compact exhibits partial density, but not full density.

The next step is to sinter the green compact at a temperature above the liquidus of the metallic binder for a preselected time and at a preselected pressure. An exemplary temperature is 2650° F. (1456° C.), and an exemplary time is 45 minutes and an exemplary pressure is 5 torr argon. The green compact may be sintered to full density.

For certain compositions (e.g., compositions Nos. 1, 2 and 3), the sintering step will result in the as-sintered substrate presenting a zone of binder enrichment beginning at or near the peripheral surface of the substrate and extending inwardly therefrom a certain distance, i.e., a binder enriched zone. The binder enriched zone exhibits a binder content which is greater than the binder content of the bulk substrate.

The next step is to grind the flank surface so as to remove the binder enriched zone which occurs during the sintering. It is optional to also grind the rake faces so as to remove the binder enriched zones. Thus, depending upon the specific application for the cutting insert, after the grinding step the cutting insert substrate may either present an as-ground flank surface and as-ground rake surfaces (which have the binder enriched zone ground off) or an as-ground flank surface (without binder enrichment) and as-sintered rake surfaces (which still present a binder enriched zone).

Figure 4:
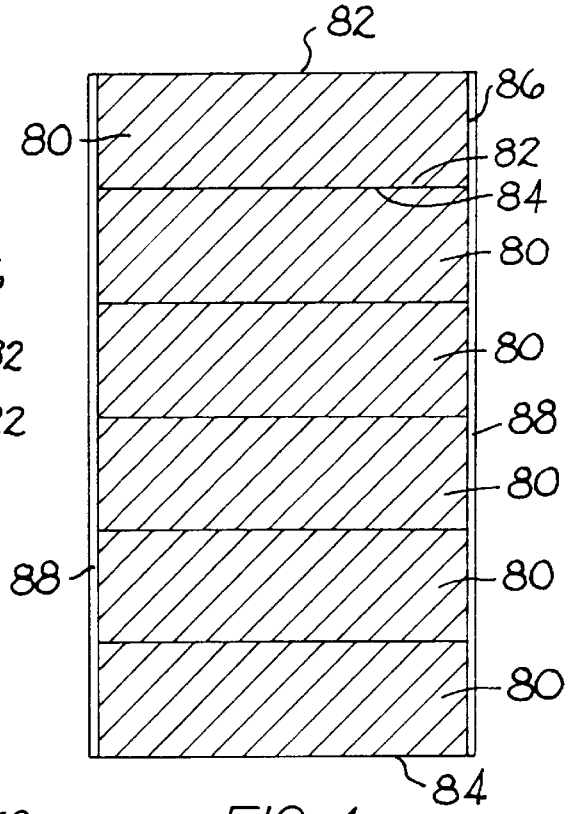
FIG. 4 is a cross-sectional view of a stack of cutting insert substrates.

Then the next step is to take a plurality of the as-ground sintered substrates 80 and stack them on top of each other. FIG. 4 illustrates a plurality of the cutting insert substrates (where the flank surfaces as well as the rake surfaces have been ground) stacked on top of each other. These substrates 80 are stacked such that, except for the top substrate and the bottom substrate, the rake face 82 is contiguous to the rake surface 84 of the adjacent substrate 80. FIG. 4 makes it readily apparent that the top rake face 82 of the top substrate 80 and the bottom rake surface 84 of the bottom substrate are exposed. The flank face 86 of each substrate 80 is exposed.

The next step comprises depositing via CVD a layer 88 of a compound on the flank faces 86 of the sintered as-ground substrates 80. The compound for layer 88 is selected so as to form upon activation solid solutions with the components of the substrate. When the substrate is a cemented carbide, the typical compounds for layer 88 include metal compounds (more preferably, carbides, nitrides, and carbonitrides) from the Group IVB, Group VB, and Group VIB transition metals such as, for example, titanium carbide, titanium nitride and titanium carbonitride.

The next step is to separate the sintered cutting insert substrates 80 and optionally remove material, i.e., grind and/or hone, from the surface regions of the substrates. Although it depends upon the particular application for the cutting insert, the substrate may be ground at the rake faces. It is typical to hone the cutting edges of the substrate. Grinding the rake faces of the sintered substrate removes any microstructure (e.g., a binder enriched zone, if present, at or near the surface of the rake faces) different from that of the bulk region.

The next step comprises the activation of the compound that comprises layer 88. The activation can occur through resintering the sintered substrate (with the layer 88 thereon) or through the localized application of heat or energy to the layer 88. The localized application of heat or energy can be applied through laser techniques or any other technique that focuses a high energy beam on (or applies high energy to) a localized area.

One result of the activation step is to cause one or more components of the substrate to diffuse toward the layer 88 so as to participate in the formation of a flank surface region. Another result of the activation step is to cause some or all of the compound which comprises layer 88 to diffuse toward the flank face of the substrate. This diffusion could be of one or more components, including one or more carbide-forming metals, of the compound toward the flank face of the substrate so as to also participate in the formation of a flank surface region. There is typically a two-way diffusion of components between the layer 88 and the substrate during the activation step wherein the majority of the diffusion, or the dominant diffusion mechanism, comprises the diffusion of the components of the substrate toward the layer 88. The preferred consequence of the activation step and the resultant diffusion mechanism is the disappearance of the distinct layer 88 and the formation of the flank surface region. The flank surface region, which presents a microstructure and composition that is different from that of the bulk substrate, begins at or near the peripheral surface of the flank face and extends a specific distance inwardly therefrom.

One typical case is where the bulk substrate is a cemented carbide-based composition that contains tungsten carbide and cobalt and the compound for layer 88 comprises titanium carbide, titanium nitride, or titanium carbonitride. During the activation step, the dominant diffusion mechanism is the diffusion of the tungsten carbide and cobalt toward the layer 88. In addition to the dominant diffusion mechanism, the titanium from the layer 88 diffuses toward the flank face. The diffusion in both directions, i.e., a two-way diffusion, forms the flank surface region (region 32 for insert 10 and region 76 for insert 50) in which there is a solid solution metal carbide of tungsten and titanium along with tungsten carbide and cobalt. The content of the (W, Ti)C in the flank surface region is higher than in the bulk region of the substrate. Upon completion of the activation step and the resultant diffusion, the distinct layer 88 of titanium nitride or titanium carbonitride ceases to exist.

In those cases in which the bulk region includes tungsten carbide, cobalt and other solid solution carbides and the compound for layer 88 comprises titanium carbide, titanium nitride, or titanium carbonitride, the components of the substrate (of which tungsten carbide is the dominant component) diffuses toward the layer 88. The titanium from layer 88 diffuses toward the substrate at the flank face whereby the two-way diffusion forms the flank surface region. The flank surface region has a higher overall content of the solid solution carbides, with (W, Ti)C being the dominant solid solution carbide, than the bulk region. The distinct layer 88 of titaniun carbide, titanium nitride or titanium carbonitride ceases to exist as a result of the two-way diffusion mechanism.

After completion of the activation step the substrate may (or may not) be ground and the cutting edge honed to a preselected dimension. In a case where the objective is to produce a cutting insert substrate which has either one or both of the rake surfaces with a microstructure and composition different from that of the bulk region, one or both of these surfaces is not ground. For example, in regard to the cutting insert substrate of FIG. 3, there are two rake surface regions which exhibits a higher binder content than that of the bulk region. To maintain these regions of higher binder content, it is typical that the rake faces would not be subjected to grinding.

The next optional step comprises the application (or deposition) of the hard coating to selected areas of the cutting insert substrate so as to form the coated cutting insert. The cutting inserts illustrated in FIGS. 2 and 3 show that the coating (26, 60) covers the entire surface of the cutting insert substrate. However, it should be appreciated that, depending upon the specific application, only selected areas of the cutting insert substrate may have a coating therein. The coating may comprise one or more layers.

As mentioned above, the coating may be applied any one of a variety of coating techniques including CVD and PVD. Previously mentioned U.S. Pat. No. 5,250,367, to Santhanam et al., discloses CVD and PVD methods to apply a hard coating to the cutting insert substrate.

In the case where the substrate is a cermet, the compound that constitutes the layer 88 would comprise compounds that form solid solution carbonitrides with the titanium in the titanium carbonitride. A suitable compound for layer 88 would comprise one hundred weight percent tungsten carbide.

All patents and other documents identified in this application are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A cutting insert comprising:

a flank face and a rake face, a cutting edge at a junction of the rake face and the flank face;

the cutting insert having a substrate comprising a bulk region including a metallic binder, and one or more of a first metal carbide, a first metal carbonitride, a second metal carbide, and a second metal carbonitride either alone or in solid solution or in mixtures;

the first metal being selected from the group consisting of the Group IVB, Group VB, and Group VIB transition metals, and the second metal being different from the first metal and being selected from the group consisting of the Group IVB, Group VB, and Group VIB transition metals;

the substrate including a flank surface region near the flank face of the substrate, the substrate including a rake surface region near the rake face of the substrate;

the flank surface region including a hard constituent comprising one or more of a solid solution of metal carbides and carbonitrides of the first metal and the second metal wherein at least a portion of the hard constituent in the flank surface region results from activation of a layer deposited on the flank surface wherein the layer contains one or more of a solid solution of metal carbides and carbonitrides of the first metal and the second metal, the content of the hard constituent in the flank surface region being greater than the content of the hard constituent of the bulk region; and the content of the hard constituent in the rake surface region being less than the content of the hard constituent in the flank surface region.

2. The cutting insert of claim 1 wherein the composition of the rake surface region is substantially the same as the composition of the bulk region.

3. The cutting insert of claim 1 wherein the metallic binder content of the rake surface region is between about 125 percent and about 300 percent greater than the metallic binder content of the bulk region.

4. The cutting insert of claim 1 wherein the metallic binder content of the bulk region is higher than the metallic binder content of the flank surface region.

5. The cutting insert of claim 1 wherein the hard constituent content in the flank surface region is between about 200 percent and about 400 percent higher than the hard constituent content in the bulk region.

6. The cutting insert of claim 1 wherein the first metal comprising tungsten; and the second metal comprising titanium, and the bulk region of the substrate comprising a major component of tungsten carbide and a minor component of solid solution carbides of tungsten and one or more of titanium, niobium, tantalum, hafnium, zirconium, and vanadium; and the metallic binder comprising cobalt.

7. The cutting insert of claim 6 wherein the bulk region of the substrate comprises the sum of tantalum and niobium being equal to up to about 12 weight percent, up to about 6 weight percent titanium, between about 3 and about 12 weight percent cobalt, and the balance being tungsten and carbon.

8. The cutting insert of claim 1 wherein the first metal comprising titanium and the second metal comprising tungsten, the bulk region of the substrate comprising tungsten carbide and the metallic binder comprising cobalt; and the flank surface region comprising cobalt and a solid solution carbide of tungsten and titanium.

9. The cutting insert of claim 1 wherein the first metal comprising titanium and the second metal comprising tungsten, the bulk region of the substrate comprising a major component of titanium carbonitride and a minor component of the solid solution carbides of titanium and one or more of tungsten, tantalum, and molybdenum; and the metallic binder comprising nickel and cobalt.

10. The cutting insert of claim 1 further including a coating bonded to the substrate, and the coating comprises one or more layers of one or more of the following components cubic boron nitride, diamond, diamond like coating, titanium carbide, titanium nitride, titanium carbonitride, alumina, and titanium aluminum nitride.

11. The cutting insert of claim 1 wherein the binder comprises one or more selected from the group consisting of cobalt, cobalt alloys, nickel, nickel alloys, iron, iron alloys, and combinations thereof.

12. A process for producing a cutting insert comprising the steps of:

sintering a powder mixture to form a sintered substrate with a rake face and a flank face, wherein the sintered substrate includes a metallic binder and a first metal carbide with the first metal selected from the group consisting of the Group IVB, Group VB, and Group VIB transition metals;

depositing a layer on the flank face wherein the layer contains one or more of a second metal carbide, a second metal carbonitride, and a second metal nitride, wherein the second metal is different from the first metal and is selected from the group consisting of the Group IVB, Group VB, and Group VIB transition metals;

activating the layer wherein at least one component of the substrate diffuses toward the layer and at least one component of the layer diffuses toward the substrate at the flank face so as to form a flank surface region near the flank face, the flank surface region having a solid solution metal carbide of the first metal and the second metal wherein the content of the solid solution metal carbide in the flank surface region is greater than the content of the solid solution metal carbide in the bulk region.

13. The method of claim 12 further including the step of coating the substrate with a coating.

14. The method of claim 13 further including, prior to the coating step, the step of forming a rake surface region in the sintered substrate near the rake face wherein the metallic binder content in the rake surface region is greater than the metallic binder content in the bulk region.

15. The method of claim 12 further including, after the sintering step, the step of removing material from selected areas of the flank face of the substrate.

16. The method of claim 12 wherein the activating step includes impinging a high energy beam on the flank face having the layer therein.

17. The method of claim 12 wherein the activating step includes sintering the substrate.

18. The method of claim 12 wherein after completion of the activation step the layer no longer exists as a discrete layer.

19. The method of claim 12 further including, after the sintering step and before the depositing step, the step of stacking a plurality of the as-sintered substrates on top of each other.

20. A coated cutting insert comprising:

a flank face and a rake face, a cutting edge at a junction of the rake face and the flank face;

the cutting insert having a substrate comprising a bulk region including a metallic binder comprising one or more of cobalt and a cobalt alloy, and the substrate further comprising tungsten carbide, tantalum carbide, and titanium carbide either alone or in solid solution or in mixtures;

the substrate including a flank surface region near the flank face of the substrate, the substrate including a rake surface region near the rake face of the substrate;

the flank surface region including a hard constituent comprising a solid solution carbide of two or more of tungsten, titanium and tantalum, the content of the hard constituent in the flank surface region being greater than the content of the hard constituent the bulk region;

the content of the hard constituent in the rake surface region being less than the content of the hard constituent in the flank surface region;

the content of the metallic binder in the rake surface region being greater than the content of the metallic binder in the bulk region and the flank surface region; and a coating adhered to the surface of the substrate.

* * * * *